United States Patent [19]

Sunnergren et al.

[11] 4,136,965

[45] Jan. 30, 1979

[54] MIXER BLOCK FOR USE IN ROTARY DRUMS

[75] Inventors: Carl E. Sunnergren, Bethlehem; John K. Simms, Bath; Dale W. Brinker, Allentown, all of Pa.

[73] Assignee: Bethlehem Steel Corporation, Bethlehem, Pa.

[21] Appl. No.: 892,367

[22] Filed: Mar. 31, 1978

[51] Int. Cl.[2] ..... B28C 5/46

[52] U.S. Cl. ..... 366/25; 366/228; 432/118

[58] Field of Search ..... 366/24, 25, 54, 220, 366/225, 228; 432/103, 118

[56] References Cited

U.S. PATENT DOCUMENTS

| | | | |
|---|---|---|---|
| 1,544,504 | 6/1925 | Tomlinson | 432/118 |
| 1,920,677 | 8/1933 | Burke | 432/118 |
| 3,423,222 | 1/1969 | McConnaughay | 366/24 |
| 3,445,099 | 5/1969 | Olsen | 432/558 |
| 3,627,289 | 12/1971 | Erman | 263/33 R |

*Primary Examiner*—Edward J. McCarthy

*Attorney, Agent, or Firm*—Joseph J. O'Keefe; Charles A. Wilkinson; John S. Simitz

[57] ABSTRACT

A mixer block used in rotary drums to improve the efficiency of mixing, drying, cooling, heating, or calcining of solid materials such as gravel, stone, fluxes and the like to produce a more uniform product with minimal production of fines and dust is described. The mixer block is especially useful when used as part of the refractory lining in a rotary kiln to calcine fluxstone such as limestone, dolomite, dolomitic limestone, magnesite and the like.

37 Claims, 7 Drawing Figures

FIG. 4
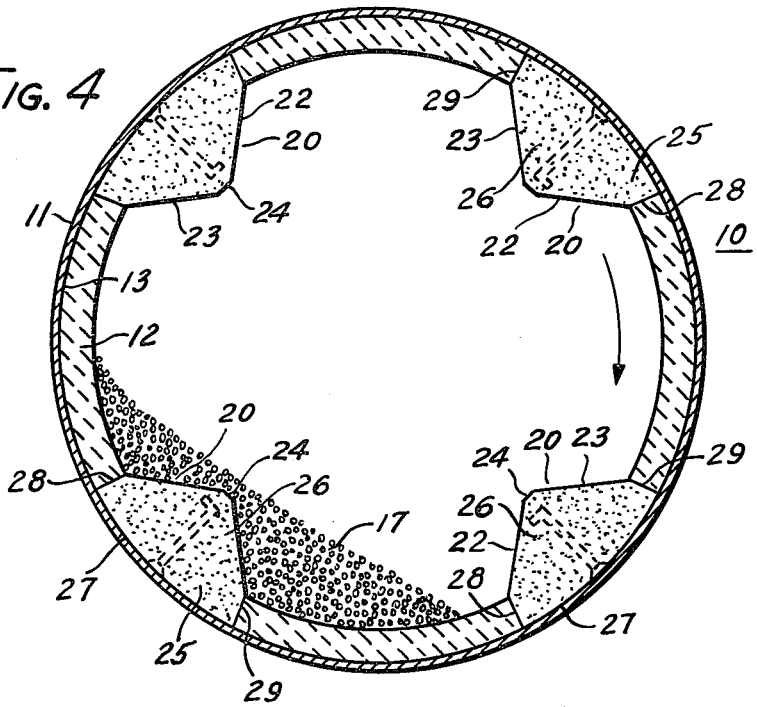
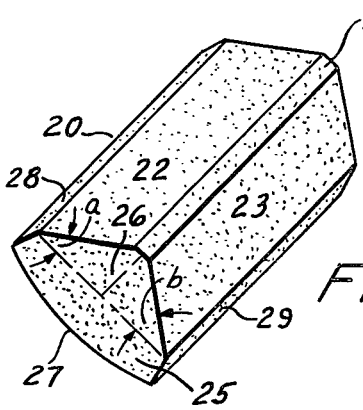
FIG. 5
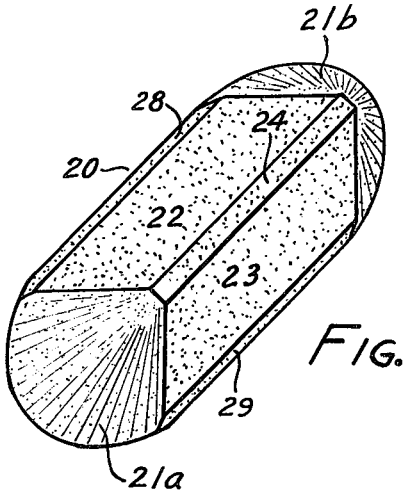
FIG. 6
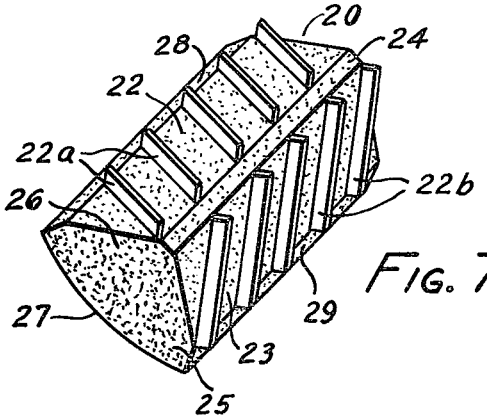
FIG. 7

MIXER BLOCK FOR USE IN ROTARY DRUMS

BACKGROUND OF THE INVENTION

This invention relates in general to an elongated mixer block which can be used in generally horizontal rotating drums to mix, dry, heat, cool or calcine solid materials. More specifically, this invention is directed to a mixer block made preferably from a refractory material and to an improved refractory lining incorporating a plurality of the mixer blocks in a generally horizontal rotary kiln whereby more efficient and uniform calcination of fluxstone is achieved while the production of fines and dust is reduced to a minimum.

Solid particles, such as gravel, sand, stone, cementitious particles, limestone, dolomite, dolomitic limestone, magnesite, fertilizers, catalysts, and the like are frequently mixed, heated, cooled, dried or calcined in a generally horizontal rotating drum or kiln. As the drum slowly rotates, the bed of particles in the drum is carried upwardly by friction a distance along the interior periphery of the drum wall. When the weight of the bed of particles overcomes friction, the particles slide downwardly to the bottom of the drum. This process is repeated as the drum continues to rotate. There is little or no mixing of the particles. As a result, the particles on the surface of the bed can be overexposed to the environment in the drum while the particles in the interior of the bed may never be exposed to the environment in the drum. Because of the poor mixing of the particles, the bed becomes non-homogenous with respect to the particle size, environment, and temperature. A so-called kidney of non-uniform particle sizes forms, which remains in the interior of the bed resulting in non-uniform processing of the bed. The process is as a consequence inefficient and produces a non-uniform unsatisfactory product.

Means to produce a more uniform product and to improve the efficiency of operation have been devised including the use of lifters or flights attached to the interior wall of rotating drums. The lifters are designed to lift the particles in the bed a distance along the interior of the drum wall and to drop the particles to the bottom of the drum. As the particles fall, they are mixed and exposed to the internal environment of the drum. Although some improvement in uniformity of the final product is thus realized, the repeated lifting and subsequent falling result in breakage of the particles. The particles are reduced in size and a large volume of fines and dust is produced. The fines and dust particles coat the larger particles thereby interfering with the mixing, drying and calcination processes. Then, too, the dust particles are so fine that many are exhausted to the atmosphere with the exhaust gases, thereby creating a hazard to the environment. It is necessary to use apparatus to collect the dust to prevent it from being passed to the atmosphere. Operational costs are thereby increased. The dust is often a waste product and cannot be used. Fine particles often must be separated from the large particles of the material in the kiln.

SUMMARY OF THE INVENTION

The invention relates to an elongated generally triangular mixer block which can be used in generally horizontal rotating drums or kilns designed to mix, dry, cool, heat or calcine solid particles of a material to produce a uniform product with minimal formation of fines and dust. The mixer block has a generally rectangular base surface and two generally rectangular converging side surfaces and two end surfaces, at least one of the end surfaces may be half-concave in shape. The included angles formed by the intersection of the base surface and each of the side surfaces of the mixer blocks are within plus 10° or minus 10° and preferably within plus 5° and minus 5° of the angle of repose of the material being treated in the drum. The height of the mixer block is designed to be at least equal to one-third the depth of the bed of solid particles in the drum. The mixer block is especially adapted to be used in a rotary kiln to calcine fluxes, for example limestone, magnesite and the like. The mixer block is preferably laid atop the hot face of the refractory lining, but can be laid-up against the inner metallic wall of the kiln. The mixer block may be prefabricated and laid as a refractory block or can be cast in situ. During the rotation of the kiln each of the mixer blocks passes consecutively through the bed of solid particles in the kiln, thereby mixing the particles and preventing the formation of a "kidney". A portion of the particles is carried a distance along the periphery of the kiln wall. Because the converging side surfaces of the mixer block have substantially the same slope as the material in the kiln, the particles are lifted a distance so that they roll or pass downwardly in layers over themselves to the bottom of the kiln. Because the particles do not fall to the bottom of the kiln, breakage of the particles is virtually eliminated. Hence, the formation of fines and dust is substantially reduced if not completely eliminated. In the process, the particles are exposed to the hot gases in the kiln resulting in a uniformly calcined product which is substantially free of fines and dust.

FIGURES OF THE INVENTION

FIG. 4 shows the rotary kiln rotated about 45° clockwise from its original position in FIG. 3 showing the position of the bed of particles during rotation of the kiln.

FIGS. 5 and 6 are isometric views of two alternative embodiments of the mixer block of the invention.

FIG. 7 is an isometric view showing the use of a plurality of flights on the surfaces of the mixer block.

PREFERRED EMBODIMENT OF THE INVENTION

Figure 1:
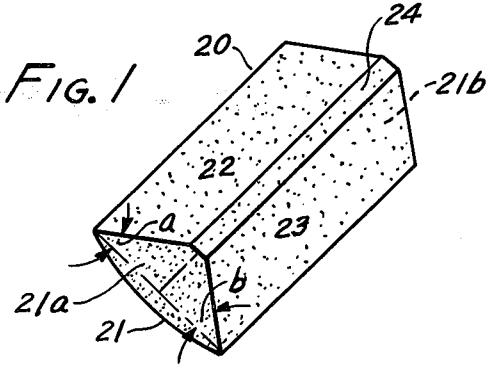
FIG. 1 is an isometric view of the mixer block of the invention.

It has been found that solid particles of a material can be mixed, dried, cooled, heated or calcined to produce a uniform product with minimal breakage of the particles and minimal formation of fines and dust in a generally horizontal rotary drum by incorporating a plurality of the mixer blocks of the invention in the interior of the drum. In these specifications and claims the terms rotary drum and rotary kiln are used interchangeably. The mixer block of the invention [as shown in FIG. 1] is generally triangular in cross-section. The mixer block can be made of any material, such as ferrous or non-ferrous metals or refractory material so long as the material will withstand the environment in which it is to be used. If made from ferrous or non-ferrous materials, the block can be made by bending the metallic plate into the desired shape or can be formed by welding or brazing metallic plates together in a generally triangular cross-section shape. The block may be preformed using refractory material or may be case in situ using castable refractory materials. In the case of a rotary kiln used to heat solid particles, the mixer block as shown in FIG. 1 is made from a refractory or coated with a refractory, for example magnesia, alumina, alumina-silica and the like, usually the same refractory composition from which the refractory blocks comprising the refractory lining are made. The mixer block 20 has a generally rectangular base surface 21 and two converging side surfaces 22 and 23 respectively, and two end surfaces 21*a* and 21*b*, and a top surface 24. The base surface 21 is generally rectangular and may be flat or slightly convex as shown in FIG. 1. If it is convex it has a radius of curvature equal to the radius of curvature of the interior wall of the rotary drum or the hot face of the refractory lining in the kiln. The curvature is usually so slight that the surface may be considered to be flat. The mixer block is laid-up contiguous with the periphery of the interior of the drum or the hot face of the refractory lining. The side surfaces and end surfaces extend inwardly into the interior of the drum a distance at least equal to one-third the depth of the particles in the bottom of the drum. As the drum slowly rotates a converging side surface 22 comes initially into contact with the particles. This first converging side surface 22 is hereinafter referred to as the leading surface. The second converging surface 23 is hereinafter referred to as the trailing surface. While we have said that the height of the mixer block is at least equal to one-third the depth of the particles in the drum, the mixer block may be large enough to extend beyond the surface of the particles. However, it is preferred to use a mixer block which is at least one-third the depth of the particles, but does not exceed about 90% of the depth of the particles. As noted previously, the leading surface 22 is the first surface of the mixer block to contact the particles as the drum rotates. The included angle "a" formed by the intersection of the leading surface 22 and the base surface 21 should be about the same angle as the angle of repose of the material in the drum. However, the included angle can be within about plus 10° to mius 10° of the angle of repose of the material in the drum. It is preferred, furthermore, to use an included angle which is within about plus 5° or minus 5° of the angle of repose of the material. The angle of repose or rest angle of a material is the maximum angle with a horizontal plane at which loose material will stand on a horizontal base without sliding. It is often between 30° and 35°. In the case of limestone it is about 38°.

When the drum rotates, the material is lifted upwardly by the leading surface 22 of the mixer block 20 for a distance along the periphery of the interior surface in the drum. Because the slope of the converging surfaces is approximately equal to the angle of repose of the material, the particles roll or pass downwardly in layers over themselves to the bottom of the drum. Since the particles do not fall downwardly, undue breakage of the particles is eliminated and the production of fines and dust is minimized. The included angle "b" formed by the intersection of the trailing surface 23 and the base surface 21 is not so important as angle "a" and need not necessarily be equal to angle "a" but it is preferred that angle "b" be also within about plus 10° to minus 10° and preferably about plus 5° to minus 5° of the angle of repose of the material in the drum.

In the following description of the mixer block we will describe its use in a rotary kiln suitable for calcining flux material, such as limestone, dolomite, dolomitic limestone, magnesite, and the like although we do not wish to be limited to such use. As defined in Hackh's Chemical Dictionary, Julius Grant, 4th Edition, 1969, page 123, calcination is defined ass "(1) oxide formation by heating oxy salts e.g. calcium oxide from calcite. (2) Expelling the volatile portions of a substance by heat." By calcination, therefore, we mean the formation of an oxide, for example calcium oxide or magnesium oxide, when heating limestone (calcium carbonate), magnesite (magnesium carbonate), dolomite (calcium and magnesium carbonate) and dolomitic limestone (calcium carbonate containing the double salt calcium and magnesium carbonate) to a temperature sufficiently high to expel carbon dioxide. In this case the mixer block is made of refractory similar to the refractory blocks in the refractory lining.

Figure 2:
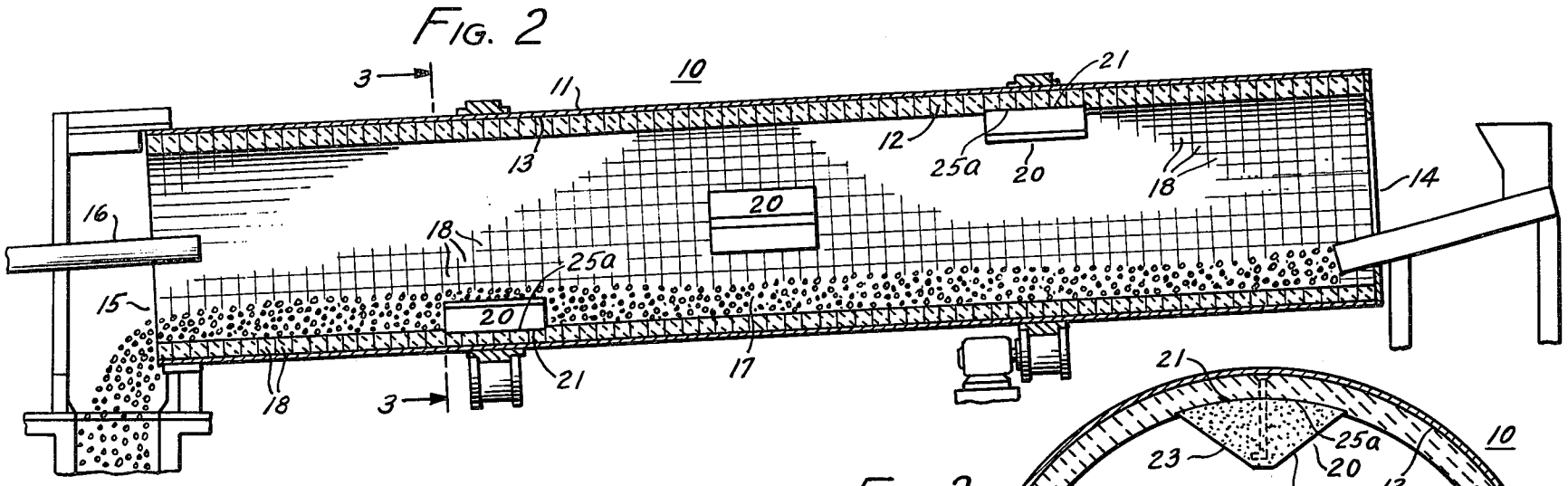
FIG. 2 is a cut-away longitudinal view of the interior of a rotary kiln showing the use of mixer blocks in the refractory lining.

Turning now to FIG. 2, a rotary kiln is shown generally at 10. The rotary kiln 10 includes an outer metallic shell 11 and a refractory lining 12 contiguous with the interior surface 13 of the shell 11. The kiln 10 has a feed or upstream end 14 and a discharge or downstream end 15. A burner 16 is provided at the end 15 of the kiln whereby hot gases are produced in the kiln 10. The hot gases flow countercurrently to the passage of the material 17 in the kiln 10.

Figure 3:
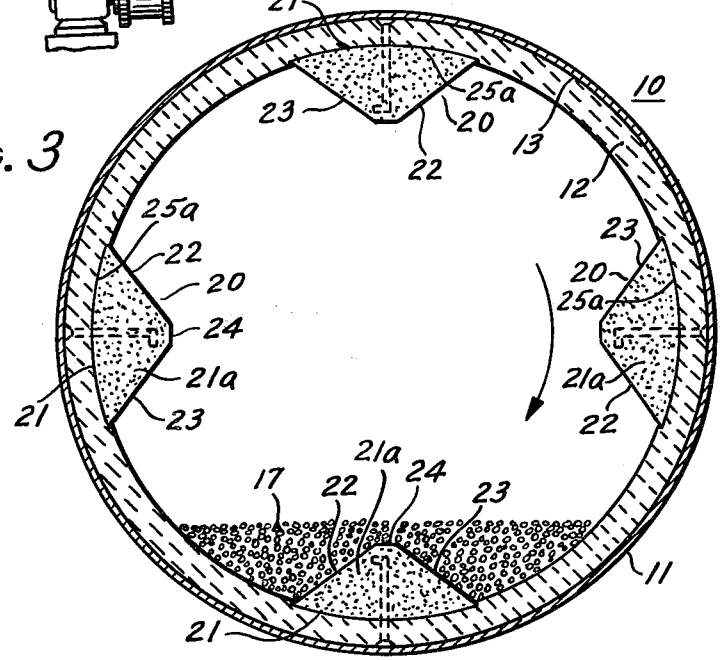
FIG. 3 is a view through 3—3 of FIG. 2 showing the rotary kiln prior to the start of rotation with a mixer block extending upwardly into the bed of particles.

The refractory lining 12 extends the length of the kiln 10 and includes a plurality of refractory blocks 18. A plurality of mixer blocks 20 are laid up contiguous with the hot face of the refractoy blocks at selected locations as shown along the length of the kiln 10. While only one mixer block 20 is shown at each location, a plurality of mixer blocks 20 [dependent upon the size of the kiln and hereinafter referred to as a set,] are evenly spaced around the periphery of the refractory lining. Each set comprises at least four mixer blocks 20. However, dependent upon the size of the kiln, a set can be comprised of any number of blocks from at least, for example, four to eight or ten mixer blocks spaced more or less evenly around the periphery of the inner wall of the kiln. The number of sets used in each kiln is dependent upon the length of the kiln. Each set of mixer blocks may be rotated a desired distance from the adjacent set peripherally around the kiln. In the case shown, the sets of mixer blocks are rotated 20° apart, however, the angle can be greater or lesser than 20°. The mixer block 20 is generally triangular in cross-section as shown in FIGS. 1 and 3. Of course it is possible to use sets of mixer blocks which form a continuous longitudinal line the length of the kiln rather than being displaced as described above.

As noted previously and as shown in FIGS. 1 and 3, the mixer block 20 has a base surface 21, two end surfaces 21*a* and 21*b* and two converging side surfaces 22 and 23 which terminate in a top surface 24 as shown. The converging side surfaces 22 and 23 if extended would meet to form the apex of a triangular cross-section, however because of manufacturing difficulties and because a sharp edge would be subject to early breakage, the mixer block 20 is preferably made with the surface 24 as the apex of the triangular cross-section. The base surface 21 as shown is a generally flat rectangular surface, however the surface may be convex to conform to the curvature of the refractory lining, and is laid-up in the refractory lining by forming a recess 25 cut into the refractory blocks 18. The converging side surface 22 is the first surface of the mixer block which contacts the particles of the material as the kiln rotates in a clockwise direction and is the leading surface. The second converging side surface 23 is the trailing surface. The included angle "a" formed by the juncture or intersection of the leading surface 22 and the base surface 21 may be about plus 10° or about minus 10° and preferably plus 5° or minus 5° of the angle of repose of the material being calcined. The included angle "b" formed by the juncture of intersection of the trailing surface 23 and the base surface 21 is also plus 10° or minus 10° and preferably plus 5° or minus 5° of the angle of repose of the material being calcined. If the base surface 21 is convex, the included angles "a" and "b" can be determined by passing a flat plane perpendicular to a radius of the kiln through the intersections of the converging side surfaces and the base surface. The angle formed by the intersection of the flat plane and the converging side surfaces forms the included angles "a" and "b". While the included angles "a" and "b" are not necessarily equal, it is preferred that the angles are equal or nearly so.

The mixer block 20 can be a preformed shape or can be cast in situ. If a preformed shape is used, the refractory blocks 18 in the refractory lining 12 are installed either recessed as previously shown at the locations desired as shown at 25 or they can be made with the base surface having a radius of curvature equal to the radius of curvature of the refractory blocks 18. If cast in situ, the bottom surface 21 will be convex and have the same radius of curvature as the hot face of the refractory lining 12. In either case, the mixer block 20 can be firmly held in place by conventional means such as bolts (shown in phantom in FIGS. 3 and 4) welded to the interior surface of the metallic shell 12 and extending radially inwardly a predetermined distance from the shell 12 to thereby provide an anchor to retain the mixer blocks in place. Of course, such means requires providing the necessary bores in the refractory blocks used in the refractory lining. The bores are filled with the same refractory as the refractory lining and mixer block 20. One such means of anchoring a refractory material is shown in U.S. Pat. No. 3,445,099 issued May 20, 1969 to G. F. Olsen et al entitled "Rotary Kiln Linings" which describes a means for fastening castable refractory linings in a rotary kiln. Various other anchoring arrangements can also be used.

We have shown the mixer block as being solid, however to conserve material and to reduce its weight, voids can be formed in the block by means well known in the art, for example, cardboard tubes of a desired size may be positioned lengthwise and the refractory material formed around the tubes.

FIG. 4 shows the position of the material as kiln 10 is rotating in a clockwise direction.

FIG. 5 shows another embodiment of the mixer block 20 of the invention. In this embodiment the mixer block 20 has a quadrilateral lower portion 25 and a generally triangularly shaped upper portion 26. The lower portion 25 has a convex bottom surface 27 which has the same radius of curvature as the interior 13 of the shell 11, and is laid contiguous with the interior 13 as shown. The lower portion 25 has two generally rectangular side surfaces 28 and 29 which are contiguous with adjacent refractory blocks 18 when laid-up in the refractory lining 12. The generally triangular upper portion 22 is the same shape as described previously and has the same surfaces, therefore we have used identical nubmers for identification. The included angles "a" and "b" can be determined by drawing a vertical plane downwardly from the surface 24 to the inner wall of the drum. A plane perpendicular to the vertical line is then drawn through the intersections of the side surfaces 28 and 22 and 29 and 23 respectively. The angles "a" and "b" formed by the perpendicular plane and the side surfaces 22 and 23, respectively, are taken as the included angles "a" and "b" of the triangular upper portion. Of course the perpendicular plane is the base surface of the upper portion 26 and the top surface of the lower portion 25. The included angles "a" and "b" can be as much as plus 10° or minus 10° but are preferably about plus 5° and minus 5° of the angle of repose of the material in the kiln. In the case of limestone, the angle of repose is 38° therefore the included angles "a" and "b" can be between 48° and 28° and preferably between 43° and 33°.

As shown in FIG. 6, the end surfaces **21*a* and 21*b* can be substantially half-conical in shape. The half-conical shape on the downstream end of the block which may be either 21*a* or 21*b*** provides easy flow of the hot combustion gases passing upstream in the kiln, around the block and also aids in the prevention of scale formation on such surface in kilns fired with coal. The half-conical shape on the upstream end surface of the block aids in the downstream flow of the solid particles around the block. The blocks may be made with one or both or neither of the end surfaces half-conical in shape, however it is preferred that at least the downstream end surface have a half-conical shape.

FIG. 7 shows the use of a plurality of flights **22*a* and 22*b* formed on the leading 22 and trailing 23 surfaces of the mixer block 20**. When material is charged into the feed end of the kiln, the material may build up at the feed end and spill out of the kiln. The flights aid in transporting the material away from the feed end thereby preventing the buildup and spillage of the material from the kiln.

To determine the breakage resulting from the use of mixer blocks of the invention as compared to the breakage caused by lifter flights which are frequently used in such rotary kilns when calcining limestone, three test runs were made on a thirty inch diameter kiln. In the first test run the kiln was equipped with one set of standard metallic lifters. The second test run was made with two sets of standard metallic lifters. The third test run was made using one set of the mixer blocks of the invention. Each test run was made by charging limestone having a particle size in the range of ¼ inch by 6 mesh (U.S.S.) to the kiln at a feed rate of 20 pounds per minute. The kiln was rotated at 1.25 rpm. All the test runs were made at room temperature. The product produced in each test run was screened. The results are shown below:

TABLE I

Comparison of Stone Breakage When Tumbling Limestone in a Kiln Equipped with Lifters and Kiln Equipped with Mixers

| Test No. | Sieve Size (U.S.S.) | Weight Percent Upstream | Weight Percent Downstream |
|---|---|---|---|
| 1 | −¼" × +4M | 25.4 | 15.6 |
| (One set | −4M × +6M | 46.7 | 39.8 |
| of | −6M × +8M | 25.3 | 44.6 |
| lifters) | −8M | 2.6 | — |
| 2 | −¼" × +4M | 29.1 | 17.8 |
| (Two sets | −4M × +6M | 48.0 | 50.7 |
| of | −6M × +8M | 21.5 | 31.0 |
| lifters) | −8M | 1.4 | 0.5 |
| 3 | −¼" × +4M | 20.2 | 20.0 |

TABLE I-continued

| Comparison of Stone Breakage When Tumbling Limestone in a Kiln Equipped with Lifters and Kiln Equipped with Mixers | | | |
|---|---|---|---|
| Test No. | Sieve Size (U.S.S.) | Weight Percent Upstream | Weight Percent Downstream |
| (One set of refractory mixer blocks) | −4M × +6M | 51.4 | 50.2 |
| | −6M × +8M | 27.3 | 28.8 |
| | −8M | 1.1 | 1.0 |

It can be seen from the above test Nos. 1 and 2 that the use of conventional lifters in a kiln results in considerable breakage of the particles as they pass through the kiln whereas there is substantially no breakage of particles when using the mixer blocks of the invention as shown in test No. 3. The virtual absence of very fine particles in test Nos. 1 and 2 indicates that a portion of the particles have been reduced to a size which is so fine that they can be swept out of the kiln in the exhaust gases. Such fine particles are not produced when using the mixer block of the invention as can be seen in test No. 3.

In a specific example of the invention, aliquot quantities of limestone were calcined in a rotary kiln which was 35 feet in length and had an inside diameter of 30 inches. Two batches of limestone were screened and found to have the following size consist:

TABLE II

| Size Consist of Limestone Prior to Calcination | | |
|---|---|---|
| Stone Size (U.S.S.) | Weight Percent #1 Batch | Weight Percent #2 Batch |
| +⅞" | 0.5 | 2.6 |
| −⅞" × +½" | 1.3 | 2.0 |
| −½" × +¾" | 15.8 | 16.7 |
| −¾" × +¼" | 43.8 | 44.3 |
| −¼" × +4M | 24.3 | 23.8 |
| −4M × +8M | 11.6 | 9.1 |
| −8M × +30M | 1.3 | 1.0 |
| −30M | 0.6 | 0.5 |

The No. 1 Batch of limestone was fed at a rate of 20.6 pounds per minute into the 30 inch diameter rotary kiln having a refractory lining which was devoid of any lifters or mixer blocks. The depth of the bed in the kiln was 3 inches. The kiln was operated at a speed of 1.25 revolutions per minute. The temperature in the kiln was 1941F (1061C). During the test run 12.5 pounds of lime per minute were produced. The calcined limestone or lime was screened and analyzed for $CO_2$ content. The size consist and carbon dioxide ($CO_2$) content are shown below:

TABLE III

| Size Consist and Carbon Dioxide Content After Calcination Without Mixer Blocks | | |
|---|---|---|
| Screen Size (U.S.S.) | Size Weight Percent | Carbon Dioxide ($CO_2$) Weight Percent |
| +⅞" | — | — |
| −⅞" × +½" | 1.1 | 3.2 |
| −½" × +⅜" | 10.4 | 0.9 |
| −⅜" × +¼" | 35.8 | 5.4 |
| −¼" × +4M | 29.5 | 20.2 |
| −4M × +8M | 17.8 | 27.0 |
| −8M × +30M | 4.1 | 18.5 |
| −30M | 1.3 | 3.2 |
| Calculated Avg. | | 13.6 |

The No. 2 Batch of limestone was fed into the same 30 inch diameter kiln, however the kiln was provided with three sets of mixer blocks of the invention. The depth of the bed in the kiln was 4 inches. The mixer blocks were 24 inches in length and the height of the triangular portions was 2-7/8 inches. Prior to rotating the kiln and with the bed of material and a mixer block at the bottom of the kiln, it was found that the triangular portion of the mixer block extended 2⅞ inches into the bed of material. This distance was equivalent to 72% of the depth of the bed. The mixer blocks were spaced 12 inches apart along the length of the kiln and were 60° apart around the periphery of the interior of the kiln. Each set of mixer blocks was rotated 20° from the preceding set of mixer blocks. The limestone was fed at a rate of 20 pounds per minute. The kiln was operated at a speed of 1.25 revolutions per minute and at a temperature of 1945F (1063C). The production rate of the run was 10.2 pounds of lime per minute. The size consist and the carbon dioxide ($CO_2$) content of the lime are shown below:

TABLE IV

| Size Consist and Carbon Dioxide Content After Calcination Using Mixer Blocks | | |
|---|---|---|
| Screen Size (U.S.S.) | Size Weight Percent | Carbon Dioxide ($CO_2$) Weight Percent |
| +⅞ | 1.5 | 4.2 |
| −⅞" × +½" | 2.2 | 1.4 |
| −½"] × +⅜" | 14.9 | 0.8 |
| −⅜" × +¼" | 38.0 | 3.8 |
| −¼" × +4M | 23.4 | 11.3 |
| −4M × +8M | 13.6 | 7.4 |
| −8M × +30M | 4.8 | 8.4 |
| −30M | 1.6 | 2.7 |
| Calculated Avg. | — | 5.8 |

The calculated average carbon dioxide ($CO_2$) content of lime produced in a kiln not equipped with mixer blocks was 13.6 weight percent as seen in Table III, whereas the calculated average carbon dioxide ($CO_2$) content of lime produced in a kiln equipped with mixer blocks was 5.8 weight percent as seen in Table IV. The lime production rate in a kiln not equipped with mixer blocks was 12.6 pounds per minute whereas the lime production rate in a kiln equipped with mixer blocks was 10.2 pounds per minute. Although it may appear that the use of mixers results in a loss of lime production, this is not the case. The apparent loss is actually due to a more thorough calcination of the limestone and the resulting larger amount of gaseous carbon dioxide which is removed during calcination when using the mixes of the invention. Thus a more thorough calcination of limestone is achieved in a kiln which is equipped with mixer blocks of the invention than in a kiln not equipped with mixer blocks.

The middle fraction of the lime product produced when using the mixer blocks of the invention had a relatively low $CO_2$ content indicating the production of a more uniform lime product. The smaller amounts of the finer sizes when using the mixer blocks of the invention shows that the mixer blocks prevent undue breakage of the limestone during calcination.

In another example of the invention, two batches of limestone were screened to determine the size consist before calcination and were calcined in the same kiln as described in the first specific example. The size consist of the calcined product was then determined. The kiln was operated at a speed of 1.25 revolutions per minute and a temperature of 1950F (1066C). The feed rate was kept constant at 20 pounds per minute. The first batch was calcined in the kiln without the use of lifters or mixer blocks and the second batch was calcined in the kiln equipped as described in the first specific example.

The size consist of the feed material and calcined product are shown below:

TABLE V

| Stone Size (U.S.S.) | Batch No. 1 Weight Percent | | Batch No. 2 Weight Percent | |
|---|---|---|---|---|
| | Feed | Product | Feed | Product |
| +⅝" | 0.5 | 0 | 2.6 | 1.5 |
| −⅝" × +½" | 1.3 | 1.1 | 2.0 | 2.2 |
| −½" × +⅜" | 15.8 | 10.4 | 16.7 | 14.9 |
| −⅜" × +¼" | 43.8 | 35.8 | 44.3 | 38.0 |
| −¼" × +4M | 24.3 | 29.5 | 23.8 | 23.4 |
| −4M × +8M | 11.6 | 17.8 | 9.1 | 13.6 |
| −8M × +30M | 1.3 | 4.1 | 1.0 | 4.8 |
| −30M | 0.6 | 1.3 | 0.5 | 1.6 |

By the use of the mixer blocks of the invention in the refractory lining the interior of the kiln, a more uniformly calcined product is produced with little if any formation of dust and small particles due to breakage of the material being calcined, calcination occurred in less time than normally required to calcine the same amount of material to the same degree, thereby resulting in an energy saving.

While we have shown the use of mixers in the calcination of flux stones such as limestone, dolomite, dolomitic limestone and the like, the mixers may also be used in rotary drums to dry such materials as sand and gravel, to heat materials to produce, for example, coke pellets suitable for calcination, fertilizers, and the coating of pellets.

We claim:

1. A mixer block suitable for use in the interior of a rotary drum to mix, dry, cool, heat or calcine solid particles of a material, comprising a base surface and two converging side surfaces arranged to form a generally triangular shape in cross-section, one of said converging side surfaces being a leading surface and the other of said converging side surfaces being a trailing surface, and end surfaces, and two included angles formed by the intersection of the base surface and the two converging side surfaces, the included angle formed by the intersection of the leading surface and base surface being between plus 10° and minus 10° of the angle of repose of the material in the rotary drum.

2. The mixer block of claim 1 in which the included angle formed by the intersection of the leading surface and base surface is between plus 5° and minus 5° of the angle of repose of the material.

3. The mixer block of claim 1 in which the two included angles are between plus 10° and minus 10° of the angle of repose of the material.

4. The mixer block as claimed in claim 1 in which the two included angles are between plus 5° and minus 5° of the angle of repose of the material in the drum.

5. The mixer block of claim 1 in which a half conical end portion is provided at least at one of the end surfaces.

6. The mixer block of claim 1 in which each of the converging side surfaces is provided with a plurality of flights.

7. An improved refractory lining in a rotary kiln which has an outer metallic shell, a feed or upstream end and a discharge or downstream end, a burner mounted axially within the shell in the discharge end whereby hot gases are produced which pass countercurrently to the passage of solid particles of a material taken from the group consisting of limestone, dolomite, dolomitic limestone and magnesite, in the kiln, the refractory lining including a plurality of refractory blocks, the improvement comprising anchoring a plurality of generally triangularly shaped refractory mixer blocks having converging side surfaces, a base surface and end surfaces and included angles formed by the intersection of the base surface and the converging side surfaces, one of the converging side surfaces being a leading surface and the other of the converging side surfaces being a trailing surface, the angle formed by the intersection of the leading surface and the base surface being between 10° and minus 10° of the angle of repose of the solid particles of the material, the mixer blocks being positioned at equally spaced selected locations around the periphery of the kiln and at selected spaced intervals along the length of the kiln whereby the solid particles of the material are carried along the periphery of the refractory lining and roll downwardly in layers upon themselves in the kiln.

8. The improved refractory lining of claim 7 in which the included angle formed by the intersection of the leading surface and the base surface is between plus 5° and minus 5° of the angle of repose of the solid particles of the material.

9. The improved refractory lining of claim 7 in which the included angle formed by the intersection of the trailing surface and the base surface of the mixer blocks is between plus 10° and minus 10° of the angle of repose of the solid particles of the material.

10. The improved refractory lining of claim 9 in which the included angle formed by the intersection of the trailing surfaces and base surfaces of the mixer blocks is between 5° and minus 5° of the angle of repose of the material.

11. The improved refractory lining of claim 7 wherein at least one set of mixer blocks is laid-up at equally spaced intervals around the periphery of the kiln.

12. The improved refractory lining of claim 7 in which the refractory lining includes at least two sets of elongated refractory mixer blocks spaced at intervals longitudinally in the kiln.

13. The improved refractory lining of claim 7 wherein the sets of mixer blocks at spaced intervals along the length of the kiln are displaced by about 20° from each other around the periphery of the kiln.

14. The improved refractory lining of claim 7 wherein the height of the mixer blocks is at least one-third the depth of the solid particles of the material in the kiln.

15. The refractory mixer block of claim 7 in which a half-conical portion is provided at least at one of the end surfaces.

16. The refractory mixer block of claim 7 in which each of said converging side surfaces is provided with a plurality of flights.

17. A refractory mixer block suitable for use in a refractory lining in the interior of a rotary kiln to calcine a material taken from the group consisting of limestone, dolomite, dolomitic limestone and magnesite, said mixer block having a generally polygonal cross-section having a quadrilateral lower portion and a generally triangular upper portion, said lower portion having a curved base surface and two converging side surfaces extending upwardly from said base surface, said triangular upper portion being an extension of said lower portion with the base surface of the upper portion being common with the top surface of the lower portion and a leading surface and a trailing surface extending upwardly from said side surfaces and forming extensions thereof, said leading surface and trailing surface converging to form a top surface, the intersection of said leading surface with said base surface of said upper portion forming an included angle which is between plus 10° and minus 10° of the angle of repose of the material being calcined and two end surfaces.

18. The refractory mixer block of claim 17 in which the included angle formed by the intersection of the leading surface and the base surface of the upper portion is between plus 5° and minus 5° of the angle of repose of the material being calcined.

19. The refractory mixer block of claim 17 in which the included angle formed by the intersection of the trailing surface and the base surface of the upper portion is between plus 10° and minus 10° of the angle of repose of the material being calcined.

20. The refractory mixer block of claim 19 in which the included angle is between plus 5° and minus 5° of the angle of repose of the material being calcined.

21. The refractory mixer block of claim 17 in which a half-conical portion is provided at least at one of the end surfaces.

22. The refractory mixer block of claim 17 in which each of said converging side surfaces is provided with a plurality of flights.

23. An improved refractory lining in a rotary drum which has an outer metallic shell, a feed end and a discharge end, and means for treating solid particles which are fed into the feed end and pass through the drum to the discharge end, said refractory lining including a plurality of refractory blocks, the improvement comprising anchoring a plurality of generally triangularly shaped refractory mixer blocks at selected locations around the periphery of the interior of the drum and at spaced intervals longitudinally in said drum, said mixer blocks having converging side surfaces, a base surface and included angles formed by the intersection of the base surface and the converging side surfaces, one of said converging side surfaces being a leading surface and the other of said converging side surfaces being a trailing surface, the angle formed by the intersection of the leading surface and the base surface being between plus 10° and minus 10° of the angle of repose of the solid particles whereby said solid particles are carried along the periphery of said interior of said drum and roll downwardly in layers upon themselves while passing through said drum.

24. The improved refractory lining of claim 23 in which the included angle formed by the intersection of the leading surface and base surface is between plus 5° and minus 5° of the angle of repose of the solid particles.

25. The improved refractory lining of claim 23 in which the included angle formed by the intersection of the trailing surface and the base surface is between plus 10° and minus 10° of the angle of repose of the solid particles.

26. The improved refractory lining of claim 25 in which the included angle is between plus 5° and minus 5° of the angle of repose of the solid particles.

27. The improved refractory lining of claim 23 wherein at least one set of mixer blocks is laid-up at selected locations around the periphery of the interior of the drum.

28. The improved refractory lining of claim 23 in which the refractory lining includes at least two sets of mixer blocks located at selected locations around the periphery of the interior and longitudinally in the drum.

29. The improved refractory lining of claim 23 wherein the sets of refractory mixer blocks are displaced by about 20° around the periphery of the inner wall of the drum.

30. The improved refractory lining of claim 23 wherein the height of said triangular portion is at least one-third the depth of the solid particles.

31. A refractory mixer block suitable for use in a refractory lining in the interior of a rotary kiln to calcine solid particles of a material taken from the group consisting of limestone, dolomite, dolomitic limestone and magnesite, the mixer block having a generally polygonal cross-section, with a quadrilateral lower portion and a generally triangular upper portion, the lower portion having a curved base surface and two converging side surfaces extending upwardly from the base surface, the triangular upper portion being an extension of the lower portion with the base surface of the upper portion being common with the top surface of the lower portion, a downstream end surface, an upstream end surface, and a leading surface and a trailing surface extending upwardly from the side surfaces and forming extensions thereof, the leading surface and trailing surface converging to form a top surface, the intersection of the leading surface and the base surface of the upper portion forming an included angle which is between plus 10° and minus 10° of the angle of repose of the solid particles being calcined.

32. The mixer block of claim 31 in which the included angle formed by the intersection of the leading surface and the base surface is between plus 5° and minus 5° of the angle of repose of the solid particles being calcined.

33. The mixer block of claim 31 in which the included angle formed by the intersection of the trailing surface and the base surface is between plus 10° and minus 10° of the angle of repose of the solid particles being calcined.

34. The mixer block of claim 33 in which the angle is between plus 5° and minus 5° of the angle of repose of the solid particles being calcined.

35. The mixer block of claim 31 in which a half-conical portion is provided at least at the downstream end surface.

36. The mixer block of claim 31 in which each of said converging side surfaces is provided with a plurality of flights.

37. The mixer block of claim 31 in which a half-conical portion is provided at each of the end surfaces.

* * * * *

UNITED STATES PATENT AND TRADEMARK OFFICE

CERTIFICATE OF CORRECTION

PATENT NO. : 4,136,965

DATED : January 30, 1979

INVENTOR(S) : Carl E. Sunnergren, et al.

It is certified that error appears in the above-identified patent and that said Letters Patent are hereby corrected as shown below:

Col. 3, line 5, "case" should read --cast--

Col. 3, line 46, "mius" should read --minus--

Col. 4, line 9, defined ass" should read --defined as--.

Col. 4, line 34, "refractoy" should read --refractory--.

Col. 6, line 1, "nubmers" should read --numbers--.

Col. 7, Table II, third line, "3/4" should read --3/8--

Col. 8, Table IV, third line, remove the bracket [] after 1/2

Col. 10, line 9, insert the word --plus-- before "10°"

Col. 10, line 31, insert the word --plus-- before "5°".

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*